US006508429B1

(12) United States Patent
Madrzak et al.

(10) Patent No.: US 6,508,429 B1
(45) Date of Patent: Jan. 21, 2003

(54) LINEAR DRIVE ASSEMBLY AND PROCESS OF USING SAME

(75) Inventors: Zygmunt Madrzak, Heidenheim (DE); Matthias Wohlfahrt, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/519,349

(22) Filed: Mar. 6, 2000

(30) Foreign Application Priority Data

Mar. 10, 1999 (DE) ..... 199 10 581

(51) Int. Cl.[7] ..... B65H 35/08
(52) U.S. Cl. ..... 242/527
(58) Field of Search ..... 242/526.3, 527, 242/527.2, 533.2, 533.3

(56) References Cited

U.S. PATENT DOCUMENTS

| | | | | |
|---|---|---|---|---|
| 2,984,426 A | * | 5/1961 | McNeaman Johnson | 242/56 |
| 3,213,735 A | * | 10/1965 | Horst-Guenter et al. | 83/353 |
| 3,277,761 A | * | 10/1966 | Dreher | 83/614 |
| 3,365,992 A | * | 1/1968 | Dreher | 83/614 |
| 3,625,813 A | * | 12/1971 | Eclelman | 162/286 |
| 3,727,853 A | * | 4/1973 | Kinoshita | 242/56 A |
| 4,343,211 A | * | 8/1982 | Volle | 83/177 |
| 4,695,004 A | * | 9/1987 | Grossmann et al. | 242/56 R |
| 4,922,776 A | * | 5/1990 | Cook | 83/398 |
| 4,982,638 A | * | 1/1991 | Brussel | 83/614 |
| 5,158,648 A | * | 10/1992 | Weldon | 162/193 |
| 5,360,179 A | | 11/1994 | Vesterinen et al. | |
| 6,135,000 A | * | 10/2000 | Caspar et al. | 83/177 |

FOREIGN PATENT DOCUMENTS

| | | |
|---|---|---|
| DE | 1449677 | 7/1969 |
| DE | 108957 | 10/1974 |
| DE | 2330195 | 1/1975 |
| DE | 2721883 | 11/1978 |
| DE | 8019703 | 10/1980 |
| DE | 3148935 | 6/1983 |
| DE | 3515519 | 10/1986 |
| DE | 3638777 | 5/1988 |
| DE | 3805164 | 8/1989 |
| DE | 9321258 | 12/1996 |
| DE | 19537173 | 12/1996 |
| EP | 543788 | 5/1993 |
| EP | 0802139 | 10/1997 |
| WO | 91/03359 | 3/1991 |
| WO | 97/48632 | 12/1997 |

OTHER PUBLICATIONS

English Translation (EP 0 802 139 A2).*
Mounting and Maintenance Instructions for Wiesel Speed-Line Mechanical Linear Drive Unit from NEFF Antriebstechnik Automation GmbH.
Keller, "Papierschneiden mit Laser", Papier+Kunstoff–Verarbeiter, pp. 32–39 (Jul. 1992).

* cited by examiner

*Primary Examiner*—Donald P. Walsh
*Assistant Examiner*—Joseph Rodriguez
(74) *Attorney, Agent, or Firm*—Greenblum & Bernstein, P.L.C.

(57) ABSTRACT

Linear drive apparatus and process of using the same. The apparatus includes a movable device and a first high-speed thrust device coupled to the movable device. The first high-speed thrust device exerts an acceleration force on the movable device to move the movable device from a ready position. A movable retaining device is coupled to the movable device, so that the retaining device is adapted to hold the movable device in the ready position against the acceleration force. A release of the movable retaining device triggers immediate movement of the movable device via the acceleration force. The process includes positioning the movable device in an idle position, holding the movable device in the idle position with the retaining device, exerting an acceleration force on the movable device while it is being held in the idle position, and releasing the movable device from the idle position by moving the retaining device. In this manner, the acceleration force moves the moving device.

8 Claims, 2 Drawing Sheets

Fig.1
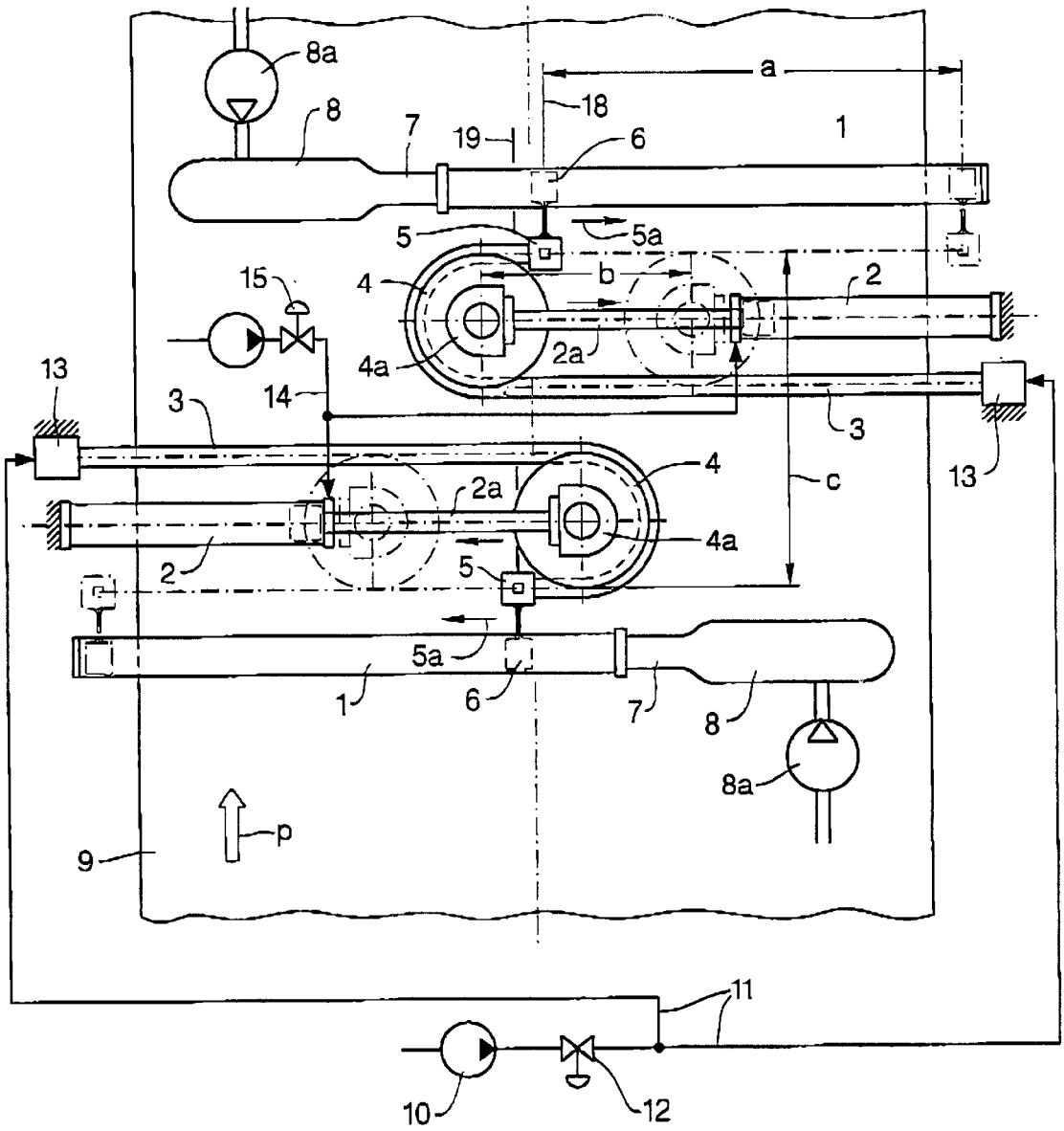
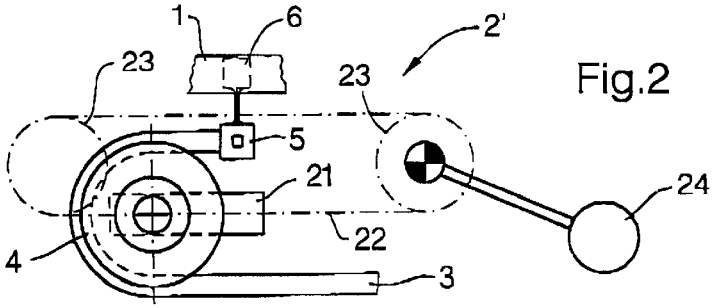
Fig.2

LINEAR DRIVE ASSEMBLY AND PROCESS OF USING SAME

CROSS-REFERENCE TO RELATED APPLICATIONS

The present application claims priority under 35 U.S.C. §119 of German Patent Application No. 199 10 581.2, filed on Mar. 10, 1999, the disclosure of which is expressly incorporated by reference herein in its entirety.

BACKGROUND OF THE INVENTION

1. Field of the Invention

The present invention relates to a linear drive assembly used for moving a component, e.g., a cutter, and a process of using the same. Such a cutter is used, e.g., in a machine for producing or refining a fibrous material web, e.g., a paper or cardboard web, preferably at the end of such a machine in the region of a winder. The moving fibrous material web is cut crosswise to the web travel direction using the cutter, in particular when, during continuous operation, a wound roll produced on a first reel spool has become full and the forming of a new wound roll is beginning on a second reel spool, i.e., during a "reel spool change", 2. Discussion of Background Information A linear drive assembly known from, e.g., German Application No. DE 27 21 883, is used for moving two cutters in opposite directions, each cutter having a circular slitting knife. The linear movement is effected by an endless cable which is driven by a friction wheel.

A device known from, e.g., U.S. Pat. No. 5,360,179, includes one or two liquid jet cutters which are moved linearly at high speed (10 m/sec) crosswise to a moving fibrous material web. Details concerning the linear drive are not described.

International Publication No. WO 97/48632 discloses a similar device, in which the linear drive has a pneumatic piston.

According to "Waterjet Turn-up System," Prospectus of the Beloit Corp., a rodless cylinder serves the same purpose. The stroke speed is approximately 15.3 m/s.

Modern machines for producing or refining (or otherwise processing) fibrous material webs, e.g., paper webs, are operated at increasingly higher working speeds. In many cases, working speeds of 2000 m/min are attempted or even exceeded. Accordingly, a cutter of the type described in the introduction must also be moved crosswise to the web at an extremely high speed because, with each cutting process, at least one diagonally running cut line is made, in the region of which the paper becomes unmarketable scrap. It has always been attempted to keep the amount of scrap as small as possible.

SUMMARY OF THE INVENTION

In this regard, an even better result can be obtained with the present invention. In other words, the present invention improves the known linear drive assembly to the effect that with its use for moving a cutter of a paper machine, there is less scrap than previously.

The present invention is directed to a linear drive assembly, as generally discussed above, that also includes a device to be moved, e.g., a cutter, which is positioned in a ready (idle) position, coupled to a first high-speed thrust device that exerts an acceleration force on the device. The device is also coupled to a retaining device, which holds the device in the ready position against the acceleration force. Upon release of the retaining device, an immediate movement of the device is triggered under the action of the acceleration force mentioned. The present invention is based on the knowledge that, in many applications for a linear drive assembly, e.g., with the movement of a cutter as described in the introduction, not only is there extremely high speed, but also care must be taken that this high speed is reached in the shortest possible time at the start of the movement, That is, provision must be made for extremely high acceleration, which can be primarily accomplished with the present invention in that a ready position is provided in which the first high speed thrust device already exerts a high acceleration force on the device to be moved while in its idle position.

However, in this state according to the invention, a retaining device holds the device to be moved in its idle position. When the retaining device is released at a selected time, the high acceleration force acts on the device to be moved from the first instant. In this case, the highest speed of the device to be moved is reached in a much shorter time than with the known devices. Preferably, the retaining device can be formed as a second high-speed thrust device such that the two high-speed thrust devices work together in a practical manner as described in detail hereinbelow.

The first high-speed thrust device can preferably be a rodless pneumatic cylinder, which is of known construction its advantage lies primarily in that its length must only be slightly greater than the length of the path of the device to be moved, Moreover, because the mass to be accelerated is very small, an extremely high acceleration is yielded. In the case of a cutter of a paper machine, the length of the path of movement depends on the width of the web to be cut (e.g., on the order of 10 m).

If two cutters are provided moving in opposite directions, the length of the path is only approximately half the web width. As an alternative to a rodless pneumatic cylinder, a drive device operating on the principle of rocket propulsion could possibly be provided.

The second high-speed trust device can preferably be formed as a so-called "mechanical linear unit," available, e.g., from the company NEFF Antriebstechnik Automation GmbH. An advantage of this device lies in that a very high speed of movement is possible with higher acceleration and in that acceleration and deceleration phases are readily controllable. A less advantageous alternative to be considered is a hydraulic cylinder.

The present invention is related to a linear drive apparatus that includes a movable device and a first high-speed thrust device coupled to the movable device. The first high-speed thrust device exerts an acceleration force on the movable device to move the movable device from a ready position. A movable retaining device is coupled to the movable device, so that the retaining device is adapted to hold the movable device in the ready position against the acceleration force. A release of the movable retaining device triggers immediate movement of the movable device via the acceleration force.

According to a feature of the invention, the movable device may include a cutter adapted to cut a continuous fibrous material web. The cutter can be arranged in a region of a winding machine for the continuous fibrous material web, and the first high-speed thrust device can extend cross-wise to a web travel direction.

In accordance with another feature of the instant invention, the continuous fibrous material web can include one of a paper and a cardboard web.

The first high-speed trust device can include a rodless pneumatic cylinder having a piston which is acted upon by pressure while in the ready position. The piston may be coupled to the movable device. The piston can also be permanently coupled to an interior of a pneumatic pressure tank.

Further, a second high-speed thrust device which can include the retaining device. The second high-speed thrust device can further include at least one deflecting device and a flexible line coupled to the at least one deflecting device. One end of the flexible line can be coupled to the movable device and the other end of the flexible line can be held stationary. In this way, the flexible line may be under tension in the ready position. The movable device can include a fluid jet cuter having at least one fluid jet nozzle, and the flexible line can include a high-pressure hose line coupled to supply cutting fluid to the fluid jet cutter The second high-speed thrust device can include a mechanical linear unit having a linearly movable element coupled via a toothed belt to a drive motor.

According to still another feature of the invention, the movable device can include a part of a laser beam cutter.

In accordance with a further feature of the invention, one of a stroke speed and a stroke acceleration of the first high-speed thrust device may be at least twice a corresponding one of a stroke speed and a stroke acceleration of the second high-speed thrust device. Further, the one of the stroke speed and stroke acceleration of the first high-speed trust device can be assisted by a deflecting roll.

The invention is directed to a reel spool changing apparatus for a continuously operating one of a web producing and refining machine. The apparatus includes two cutters which are movable in opposite directions to cut the web, and two first high-speed thrust devices, arranged in cross-wise directions to the web, coupled to the two cutters. The first high-speed thrust devices exert an acceleration force on the two cutters to move the two cutters from a ready position. Two movable retaining devices are coupled to the two cutters, and the retaining devices are adapted to hold the two cutters in their ready positions against the acceleration forces. A release of the movable retaining devices triggers immediate movement of the two cutters via the acceleration force.

According to a feature of the present invention, the two cutters may include high-pressure fluid jet nozzles. Further, the high-pressure fluid jet nozzles may exert a fluid pressure at least in a range between approximately 1000–2000 bar. Still further, the first high-speed thrust devices may include rodless cylinders having pistons coupled to the two cutters. Moreover, second high-speed thrust devices can include the movable retaining devices. The second high-speed thrust devices can firer include cylinder/piston devices having piston rods, and the piston rods may be coupled to the movable retaining devices. Alternatively, the second high-speed thrust devices can further include movable elements coupled to driven belts, and the movable elements may be coupled to the movable retaining devices.

The instant invention is directed to a linear drive apparatus for driving cutting assembly in a region of a web winding device. The apparatus includes at least one movable device comprising a cutting device, and first high-speed thrust devices respectively coupled to each the movable device. The first high-speed thrust devices exert an acceleration force cross-wise to a web run direction on tie movable devices to move the movable device from a ready position. Movable retaining devices are respectively coupled to each the movable device, and the retaining devices are adapted to hold the movable devices in the ready position against the acceleration force. The first high-speed thrust devices include a rodless pneumatic cylinders having pistons which are acted upon by pressure while in the ready position, and the pistons are respectively coupled to each the movable devices. Second high-speed thrust devices include the retaining devices. A release of the movable retaining devices triggers immediate movement of the movable devices via the acceleration force.

The present invention is directed to a process of cutting a material web in a region of a winding machine with a cutting device driven by a linear drive that includes a movable device coupled to a cutter, a first high-speed thrust device coupled to the movable device, and a movable retaining device coupled to the movable device. The process includes positioning the movable device in an idle position, holding the movable device in the idle position with the retaining device, exerting an acceleration force on the movable device while it is being held in the idle position, actuating the cutter to cut the web while the movable device is held in the idle position, and releasing the movable device from the idle position by moving the retaining device. In this manner, the acceleration force moves the moving device.

In accordance with a feature of the present invention, the process can further include actuating the cutter to cut the web while the movable device is held in the idle position, According to yet another feature of the invention, the acceleration force can be directed cross-wise to a web run direction.

Other exemplary embodiments and advantages of the present invention may be ascertained by reviewing the present disclosure and the accompanying drawing,

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 1 schematically illustrates a linear drive assembly for two cutters to be moved in opposite directions, each with a first and a second high-speed thrust device;

FIG. 2 illustrates an alternative detail from that depicted in FIG. 1.

DETAILED DESCRIPTION OF THE PRESENT INVENTION

Figure 3:
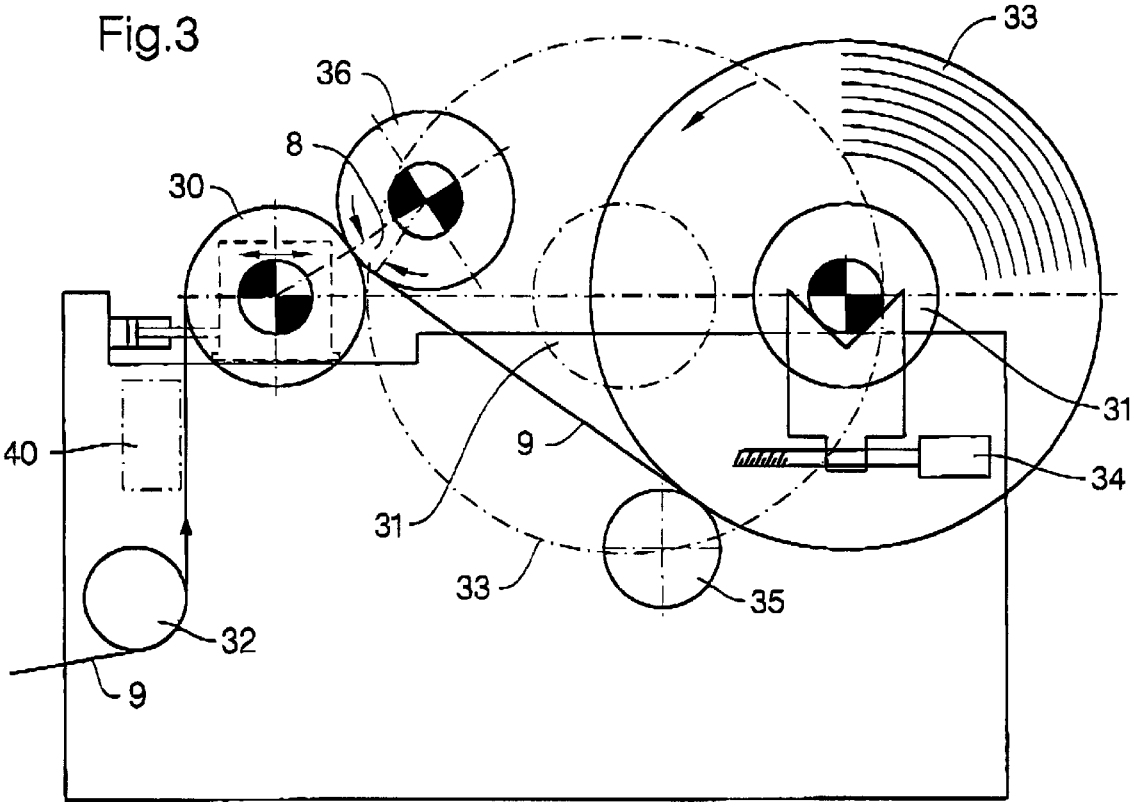
FIG. 3 schematically illustrates a winding machine in a side view with a linear drive assembly according to the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard no attempt is made to show structural details of the present invention in more detail than is necessary for the fundamental understanding of the present invention, the description taken with the drawings making apparent to those skilled in the art how the several forms of the present invention may be embodied in practice.

FIG. 1 illustrates a section of a continuous fibrous material web 9 traveling in the direction of the arrow P. Two movable devices, e.g., cutters 5, in the form of fluid jet nozzles, are provided. Cutters 5 are depicted in their ready or idle position in a region of the center of the web and are positioned at a short distance from web 9. The fluid jet directions run approximately perpendicular to the plane of the drawing, i.e., essentially perpendicular to continuous web 9 or at an angle to the perpendicular. The feeding of cutting fluid is carried out by a high-pressure pump 10, which can generate a fluid pressure on the order of as much as approximately 2000 bar or more. Pump 10 is connected via a pipe system 11 with a control valve 12 and via high-pressure hose lines 3 with cutters 5. FIG. 1 is depicted in a state shortly after the opening of control valve 12, i.e., when the cutting process has just begun and cutters 5 are still in their idle positions. Because the cutters are stationary at this point, two cutting lines 18 and 19 are initially generated, which extend parallel to web travel direction p. A short time later, when cutters 5 are moved in the direction of arrow 5*a* toward the edges of web 9, a diagonal cutting line course is produced (see, e.g., FIG. 10 of German Application No. 27 21 883 or FIG. 8 of International Publication No. WO 97/48632). In an alternative arrangement from the exemplary embodiment depicted in FIG. 1, cutters 5 can also be arranged so that the diagonal cutting lines intersect (see, e.g., FIG. 6 of International Publication No. WO 97/48632) or so that the cutters are positioned one immediately behind the other (see. e.g., FIG. 7 of International Publication No. WO 97/48632).

Each cutter 5 is mechanically coupled to a piston 6 of a rodless pneumatic cylinder 1, which forms a first high-speed thrust device. Each pneumatic cylinder 1 is linked at one of its two ends through a pressure line 7 (with a large flow cross-section) to a pressure tank 8, which is, in turn, coupled to a compressed air generator 8*a*.

One end of high-pressure hose line 3 is coupled to cutter 5, and the other end is coupled to a stationary structural element 13, which couples hose line 3 to pipe system 11. In the exemplary embodiment, high-pressure hose line 3 can be deflected by approximately 180 degrees by a deflection device 4. Deflection device 4 can be formed, e.g., as a deflecting roll, and can be attached to a movable element 2*a* of a second high-speed thrust device 2. As shown in FIG. 1, deflecting roll 4 can be rotatably mounted in a bearing 4*a*, which is coupled to the end of a piston rod 2*a* of a hydraulic cylinder 2.

An alternative embodiment is depicted in FIG. 2 in which deflecting roll 4 is rotatably mounted on a linearly movable element 21, which is a component of a mechanical linear unit 2'. Linearly movable element 21 is coupled to a drive motor 24 through an endless toothed belt 22 (guided by pulleys 23).

With both embodiments of second high-speed thrust device 2 or 2', provision is made by the guidance of hose 3 over deflecting roll 4 that, with the movement of cutters 5 over path a, movable element 2*a* or 21 need only to cover approximately one-half of path a, i.e., path b. Moreover, if hose 3 is guided, not by a single deflecting roll 4, but by a plurality of deflecting rolls, e.g., in the manner of a block and tackle, the ratio of paths a/b can be greater than approximately 2.

As noted above, FIG. 1 depicts the ready position of the linear drive assembly. Even in the ready position, piston 6 is already under pressure on the side of pressure tank 8. Cutter 5, which is coupled to piston 6, is retained or held in the ready position by second high-speed thrust device 2 via hose 3.

As soon as a second thrust device 2 or 2' is activated, e.g., by introducing hydraulic pressure via pipe system 14 with control valve 15, or by activation of drive motor 24 (see, FIG. 2), cutter 5 is set in motion with high acceleration.

In an alternative to the embodiment depicted in FIG. 1, the ready position can be positioned so that each of the pistons is located immediately at the end of the pneumatic cylinder 1 (i.e., at the connection to pressure line 7). In this manner, cutters 5 can generate intersecting cutting lines (see, e.g., FIG. 6 of International Publication No. WO 97/48632). Moreover, it is also possible not to have the high-pressure cutting fluid act on nozzles 5 until after they have traveled part of their path, e.g., when they have reached approximately the central region of paper web 9.

In FIGS. 1 and 2, the rotational axes of deflecting rolls 4 can be substantially perpendicular to paper web 9. However, it may be particularly advantageous to set up an arrangement so that the axes of rotation of deflecting rolls 4 are parallel to paper web 9 such that second thrust devices 2 or 2' (according to the arrangement depicted in FIG. 1) is located above cutter 5. Thus, cutters 5 can be moved closer to each other (i.e., distance c can be reduced).

Essential components of a winding machine depicted in FIG. 3 include a drivable and horizontally movable pressure roll 30 and a drivable reel spool 31. During a normal winding process, paper web 9 runs over a guide roll 32 and over pressure roll 30 onto a wound roll 33 (which has a constantly increasing diameter). This is created by winding the reel spool 31, during which it is in contact with a pressure roll 30 (as shown by the dot-dash line).

Depending on the increase in diameter, reel spool 31 is constantly displaced along with wound roll 33, to the right in the view according to FIG. 3 via, e.g., a driving spindle 34. In preparing for a reel spool change (i.e., when wound roll 33 has almost reached its desired diameter), reel spool 31 with wound roll 33 can be moved away from pressure roll 30 into the position depicted by solid lines, An auxiliary roll 35 can press approaching web 9 against wound roll 33. Now, a new, still empty reel spool 36 can be placed in the winding machine.

Preferably, new reel spool 36 can be brought into contact with pressure roll 30 in such a position that paper web 9, which still runs to wound roll 33, surrounds a section of new reel spool 36, e.g., by a surrounding angle 8. Preferably, in a region 40, i.e., between guide roll 32 and pressure roll 30, or above pressure roll 30, or between pressure roll 30 and auxiliary roll 35, a cutter with the above described linear drive assembly can be provided. It is possible to provide a single cutter which cuts the entire paper web from one web edge to the other web edge, or two cutters can be provided as depicted in FIG. 1. In any case, provision is made for the new web front end formed at the cutting line to be guided over new reel spool 36 so that the forming of a new wound roll can begin.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A linear drive apparatus comprising:

a movable device;

a first high-speed thrust device coupled to said movable device, wherein said first high-speed thrust device exerts an acceleration force on said movable device to move said movable device from a ready position;

a movable retaining device coupled to said movable device, wherein said retaining device is structured and arranged to hold said movable device in the ready position against the acceleration force, wherein a release of said movable retaining device triggers immediate movement of said movable device via the acceleration force; and a second high-speed thrust device which comprises said retaining device, wherein said second high-speed thrust device further comprises at least one deflecting device and a flexible line coupled to said at least one deflecting device, and wherein one end of said flexible line is coupled to said movable device and the other end of said flexible line is held stationary, so that said flexible line is under tension in the ready position.

2. The apparatus in accordance with claim 1, wherein said movable device comprises a fluid jet cutter having at least one fluid jet nozzle, and wherein said flexible line comprises a high-pressure hose line coupled to supply cutting fluid to said fluid jet cutter.

3. The apparatus in accordance with claim 1, wherein said movable device comprises a part of a laser beam cutter.

4. A linear drive apparatus comprising:

a movable device;

a first high-speed thrust device coupled to said movable device, wherein said first high-speed thrust device exerts an acceleration force on said movable device to move said movable device from a ready position;

a movable retaining device coupled to said movable device, wherein said retaining device is structured and arranged to hold said movable device in the ready position against the acceleration force, wherein a release of said movable retaining device triggers immediate movement of said movable device via the acceleration force; and a second high-speed thrust device which comprises said retaining device, wherein said second high-speed thrust device comprises a mechanical linear unit having a linearly movable element coupled via a toothed belt to a drive motor.

5. A linear drive apparatus comprising:

a movable device;

a first high-speed thrust device coupled to said movable device, wherein said first high-speed thrust device exerts an acceleration force on said movable device to move said movable device from a ready position;

a movable retaining device coupled to said movable device, wherein said retaining device is structured and arranged to hold said movable device in the ready position against the acceleration force, wherein a release of said movable retaining device triggers immediate movement of said movable device via the acceleration force;

a second high-speed thrust device which comprises said retaining device, wherein one of a stroke speed and a stroke acceleration of said first high-speed thrust device is at least twice a corresponding one of a stroke speed and a stroke acceleration of said second high-speed thrust device, and wherein the one of the stroke speed and stroke acceleration of said first high-speed thrust device is assisted by a deflecting roll.

6. A reel spool changing apparatus for a continuously operating one of a web producing and refining machine comprising:

two cutters, comprising high-pressure fluid jet nozzles, which are movable in opposite directions to cut the web;

two first high-speed thrust devices, arranged in cross-wise directions to the web, coupled to said two cutters, wherein said first high-speed thrust devices comprise rodless cylinders having pistons coupled to said two cutters to exert an acceleration force on said two cutters to move said two cutters from a ready position;

two movable retaining devices coupled to said two cutters, wherein said retaining devices are adapted to hold said two cutters in their ready positions against the acceleration forces, wherein a release of said movable retaining devices triggers immediate movement of said two cutters via the acceleration force; and second high-speed thrust devices that include said movable retaining devices.

7. The apparatus in accordance with claim 6, wherein said second high-speed thrust devices further include cylinder/piston devices having piston rods, and wherein said piston rods are coupled to said movable retaining devices.

8. The apparatus in accordance with claim 6, wherein said second high-speed thrust devices further include movable elements coupled to driven belts, and wherein said movable elements are coupled to said movable retaining devices.

* * * * *